US005582549A

United States Patent [19]

File

[11] Patent Number: 5,582,549

[45] Date of Patent: Dec. 10, 1996

[54] METHOD OF PLAYING A BOWLING GAME

[76] Inventor: Jon P. File, 210 S. Washington Ave., Louisville, Colo. 80027

[21] Appl. No.: 494,328

[22] Filed: Jun. 26, 1995

[51] Int. Cl.[6] ..... A63D 3/00

[52] U.S. Cl. ..... 473/54

[58] Field of Search ..... 473/54, 55, 70

[56] References Cited

U.S. PATENT DOCUMENTS

| | | | |
|---|---|---|---|
| D. 279,693 | 7/1985 | Kovacs . | |
| 463,454 | 11/1891 | Rogers . | |
| 1,124,365 | 1/1915 | Virgien, Sr. . | |
| 2,329,963 | 9/1943 | Whittle | 273/37 |
| 2,610,055 | 11/1952 | Goodyear | 273/39 |
| 3,009,268 | 11/1961 | George, Sr. | 35/29 |
| 3,241,837 | 3/1966 | Polk . | |
| 3,401,933 | 9/1968 | Conklin et al. | 273/37 |
| 3,857,569 | 12/1974 | Goldfarb et al. . | |
| 3,907,290 | 9/1975 | Fischer et al. | 273/54 |
| 3,990,702 | 11/1976 | Chopp . | |
| 4,131,948 | 12/1978 | Kaenel | 364/900 |
| 4,330,122 | 5/1982 | Sheinberg et al. | 273/51 |
| 4,501,426 | 2/1985 | Seitz | 273/277 |
| 4,597,575 | 7/1986 | Kosof | 473/54 |
| 4,689,742 | 8/1987 | Troy et al. | 364/412 |
| 4,754,967 | 7/1988 | Edler et al. | 273/43 |
| 4,787,633 | 11/1988 | Fritzemeier . | |
| 4,789,157 | 12/1988 | Gautraud | 473/54 |
| 4,834,378 | 5/1989 | Brim | 273/37 |
| 4,834,381 | 5/1989 | Brim | 273/37 |
| 4,884,806 | 12/1989 | Brim . | |
| 4,887,813 | 12/1989 | Chiles, III et al. | 273/54 |
| 4,900,024 | 2/1990 | Chandler et al. | 273/37 |
| 4,937,772 | 6/1990 | Chavez et al. | 364/715.01 |
| 5,118,105 | 6/1992 | Brim et al. | 273/54 |
| 5,165,693 | 11/1992 | Handlon, Sr. . | |
| 5,198,976 | 3/1993 | Form et al. | 364/410 |
| 5,255,185 | 10/1993 | Mowers et al. | 364/411 |
| 5,342,059 | 8/1994 | Briem et al. | 273/277 |
| 5,344,199 | 9/1994 | Carstens et al. | 273/138 |
| 5,359,510 | 10/1994 | Sabaliauskas | 364/410 |

FOREIGN PATENT DOCUMENTS

| | | |
|---|---|---|
| 1174666 | 7/1964 | Germany . |
| 2043857 | 3/1972 | Germany . |
| 2403151 | 8/1974 | Germany . |
| 471587 | 4/1969 | Switzerland . |

OTHER PUBLICATIONS

No. 45,789 Dec. 5, 1985 Texas Trademark Registration for the Mark Placement Mark 5.

"The Competition", *BOWLISTIC Parent Company Investment Offering* (Mar. 1994), pp. 9–12 and 30–35.

"Building Lineage with the Forty Frame Game", *Bowling Industry Magazine,* reprint (Dec. 1993), 10 pages.

*Primary Examiner*—William M. Pierce

*Attorney, Agent, or Firm*—Gunn, Lee & Miller, PC

[57] ABSTRACT

A method of playing a multi-frame game on a bowling alley in which the player or players are allowed to select from a menu of "bonus" and/or penalty frames for a player selected or randomly selected locations between the first and last frame of the game. "Bonus" frames are scored according to an ancillary scoring system that may or may not be related to a pin total for a particular frame.

7 Claims, 1 Drawing Sheet

METHOD OF PLAYING A BOWLING GAME

FIELD OF THE INVENTION

This invention generally relates to the sport of bowling and, particularly, to a method of playing a bowling game on a bowling alley.

BACKGROUND OF THE INVENTION

Conventional bowling is played on a standard bowling alley under scoring and regulations developed by the American Bowling Congress. These standard regulations are assumed to be understood by the person of ordinary skill in the art and are used in sanctioned regulation play. However, playing according to regulation scoring provides the most benefit to the skilled player, as the scoring is designed to minimize the luck factor. This is often frustrating for novices or players of low-skill levels. It is especially frustrating when players of a variety of skill levels compete with one another. Often, the less-skilled players become frustrated or bored.

Thus, a need exists to provide a method to modify or augment regulation bowling scoring to increase the luck/chance factor and, therefore, provide more entertainment to the bowlers while not penalizing the skilled players.

SUMMARY OF THE INVENTION

Applicant's invention provides such a system wherein a player or players may select the number of frames to comprise a game, the number typically being from 5 to 100 fames and usually, but not necessarily, a whole multiple of regulation 10-frame games. Next, the player chooses one or more menu frames, the menu frames providing a non-regulation score and being either a "bonus" frame (potentially beneficial) or a penalty frame (potentially detrimental). The non-regulation scoring system may be related to the regulation score or provide an ancillary score system not dependant upon the players' regulation score. The non-regulation score is totaled for the full number of frames comprising the multi-frame game to provide a non-regulation score which may then be used to decide the winner (the individual with the highest non-regulation ancillary score) or used to award a cash award or other prize. While non-regulation scoring is being recorded as the game is played, the option exists to also provide regulation scoring for each 10 frames played.

Thus, applicant provides for "two tier" scoring in a multi-frame game, regulation scoring, as well as a non-regulation score in which, typically, the luck factor is greater. The non-regulation score may or may not be provided in every frame. That is, the player or players may preselect, or allow a computer to-randomly select, one or more menu frames to be placed randomly or at preselected designated frames in the multi-frame game. The menu frames will control the non-regulation scoring and typically be of a bonus type or a penalty type. The bonus type of menu scoring will have a potential positive effect on the non-regulation scoring and the penalty type of menu scoring frame will have a potential negative effect on the non-regulation scoring.

The player or players have the ability to either scramble the menu frames by allowing a computer or other means to randomly select from the menu and randomly place such selected "bonus" and/or penalty frames onto the preselected number of frames, somewhere between the first and last frame inclusive.

Or, the player or players have the ability to create their own game by choosing the number of frames required to complete a game and then choosing menu frames and their exact location within the game frame, or allow a computer to select the menu frames, which may then be predisclosed to the player such that he see, for example, that in the 14th frame of a 20-frame game, he has a penalty frame or the computer may disclose only the nature of the menu frame, if any, only as the game unfolds.

Further, applicant's method of playing a bowling game includes the ability to handicap players of different skills, allowing games to be manually or computer customized for providing additional "bonus" frames to the less skilled player and/or additional penalty frames to the more skilled player.

The benefits of applicant's multi-frame game are several. First, the high scratch or handicapped bowler for the night may not win any of the non-regulation scored games and the awards or money pots related to such non-regulation scored games. Further, applicant's method allows sanctioned league play or regulation scoring to occur simultaneously with the non-regulation scoring, therefore adding more excitement to the game for bowlers and non-bowling spectators. Further, applicant's method allows much versatility in creating one's own game by preselecting desired menu scoring frames. The opportunities and combinations of games are thus increased.

DETAILED DESCRIPTION OF THE PREFERRED EMBODIMENT

Figure 1:
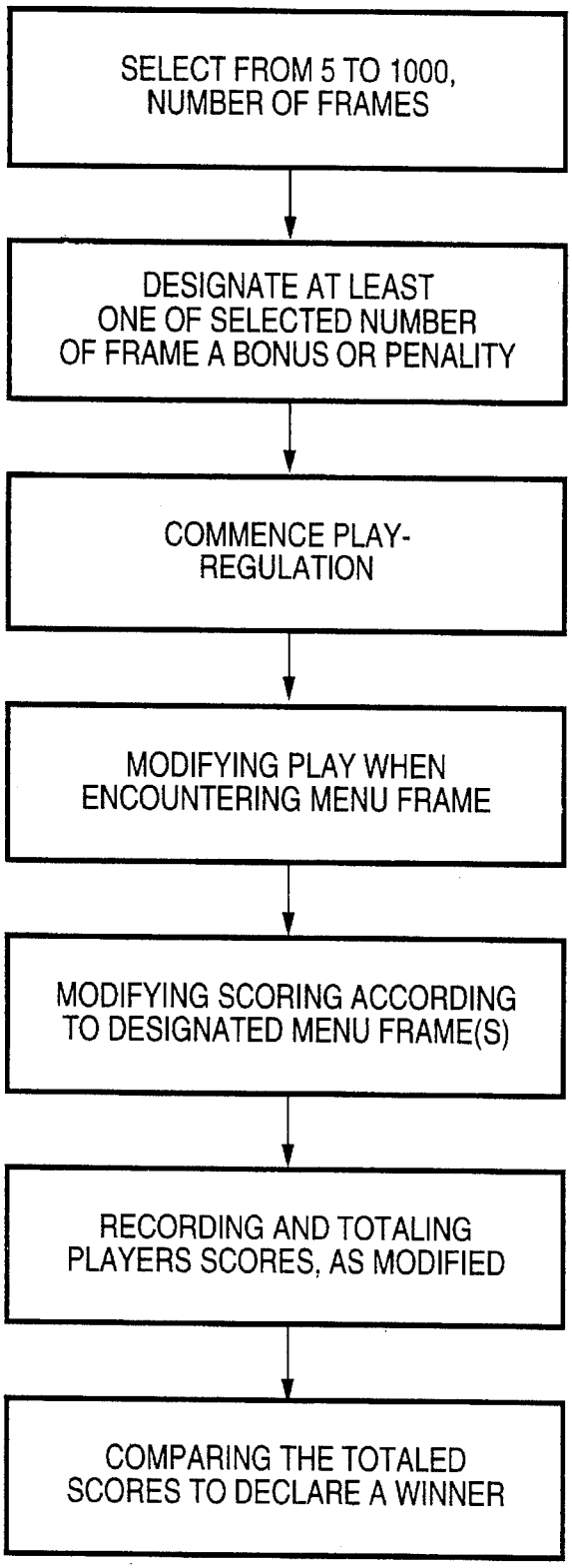
FIG. 1 shows a flow chart of the preferred method.

In playing the bowling game according to applicant's unique method, the first step includes selecting the number of frames for a complete game. A complete game is preferably from 5 to 100 frames long, but may be less or more. Typically, the number of frames comprising a complete game will be a multiple of 10, that is, 10, 20, 30, 40, etc. Selecting the frames in multiples of 10 allows the player to score complete regulation scoring games. If, for example, a 30-frame game is chosen, the player or players will complete one game according to applicant's non-regulation scoring system by playing 30 frames but will also complete 3 regulation games. Thus, the player may have bowled a 3-game series according to standard bowling regulation, but played only a single game according to the non-regulation score.

If the player or players select a 15-frame game, then only one complete mandatory regulation scored game is played along with 5 additional frames to comprise a 15-frame game scored according to applicant's non-regulation scoring method. By providing the option of parallel or 2-tier scoring, the player enjoys the benefits of regulation play as well as enjoyment of playing a game scored according to menu scoring.

The second step for the player to take in preparation for actually beginning physical play of the game is to designate, from a menu, one or more "bonus" and/or penalty frames. Applicant provides in Table 1 a sample of menu scoring illustrating the effect on the non-regulation scoring as either potentially positive for a "bonus" frame or potentially negative for a "penalty" frame. It is noted that there are a variety of ways of enhancing scoring or penalizing scoring, and they are listed by a number or letter or other indicia as well as, typically, an arbitrary or suggestive term.

TABLE 1

(Menu Scoring)

| BONUS - Positive | | PENALTY - Negative | |
|---|---|---|---|
| Effects on Regulation Pin Scoring | Effects on Ancillary Pin Scoring | Effects on Regulation Pin Scoring | Effects on Ancillary Pin Scoring |
| 1. No Tap | 2. Jack Pot | 7b. Tails | 5. Gas Attack |
| 4. Take Two | 6. Gold mine | 12. Hold-Up | 8. Penalty Box |
| 7a. Heads | 10. Oil Wel | 14. Jailhouse | 11. Hangman |
| 13. Treasure chest | 17. Lucky Seven | | 18. Boot Hill |
| 16. Maverick | 19. Hammer Down | | 22. Oops! |
| | 21. Splitsville | | 24. Transfer (–) |
| | 23. Transfer (+) | | |

For example, Table 1 illustrates that designating a "Jackpot" will mean that the player bowling a strike in that frame will receive 10 ancillary points. Likewise, a player or a computer may choose to penalize a player with, for example, a "Hangman". A frame designated "Hangman" is a penalty frame in which the player, failing to bowl a strike, will lose all the ancillary points accumulated up to this frame. Table 1 is provided only to list specific examples of types of "bonus" or penalty frames and is intended to be illustrative only.

The designation of frames may be done by the player or a computer to designate the frames. For example, a player may desire to have no penalty frames at all in a game and only "bonus" frames. A player may then manually choose to place the "bonus" frames at any desired frame locations or allow a computer to scramble and randomly place the "bonus" frames within the multi-frame game. Other players may desire to have the computer first randomly choose a number of "bonus" frames, then select a second number of penalty frames, and then scramble the selections for random placement.

At this point, the player or computer has selected a number of frames to comprise a game, provided a menu and selected from the menu having penalty frames and "bonus" frames so as to customize and actually determine the format of the specific game to be played. The format of the game is taken to mean the type and location of the menu scored frames. The format may or may not be predisclosed to the player or may be disclosed as the game is played. This, again, is another choice that the player or players have.

Play of the game is then commenced by delivering a ball to a standard array of 10 preset pins. The scoring, however, is modified from regulation play when and if a player encounters a designated menu frame. For example, when a penalty frame is encountered, scoring is affected is some negative manner, for example, by the potential for loss of points. However, regulation play is followed, for example, in determining the number of balls rolled per frame. In a first preferred embodiment, it is the regulation scoring that is typically modified. In a second preferred embodiment of applicant's game play as set forth in more detail below, an ancillary scoring system is provided, apart from regulation play. In either preferred embodiment of applicant's game play, regulation scoring may be recorded simultaneously with the non-regulation scoring system.

An example of a preferred embodiment of applicant's game is set forth in Example 1. Example 1 illustrates a 20-frame game played by one player.

In this preferred embodiment, the applicant has kept regulation score on a document (such as a sheet of paper or computer monitor) in which 20 frames have been chosen and lined (or displayed) as 1–10 and 11–20 to mimic two 10-frame, regulation games. Regulation scoring is maintained on the sheet in the top portion of the diagonally bisected box representing a frame. In the lower portion of the diagonally bisected box representing a frame is kept an ancillary score. Applicant now refers to the hypothetical player reflected in Example 1, here arbitrarily designated as "Sally", as she rolls and scores a few frames according to this particular preferred embodiment of applicant's claimed method. Sally has started the game with a strike, following up with a spare, a strike, a strike, and finally (in Sally's fifth frame) an open frame. It is assumed that the reader understands regulation scoring to see how the score of 90 was reached in the fifth frame. However, turning to Sally's non-regulation scoring, it is seen that the "Jackpot" has awarded Sally 10 bonus points in frame 1, with frames 3, 4 and 5 also being menu scored. Frame 1 was designated a "Jackpot", frame 3 an "Oil Well", frame 4 a "Money Pit", and frame 5 a "Hangman". To determine the effect of the menu-scored frames (bonus or penalty), Example 1 is consulted. Each of the menu-scored frames has indicia in the form of arbitrary or suggestive words and/or clever designs. Thus, to follow Sally's scoring in her first 5 frames according to the non-regulation or menu scoring, it is seen that Sally's strike in the first frame, designated a "Jackpot", afforded her 10 ancillary points. Her third frame was the "Oil Well", which provided her 5 additional points for bowling a strike. Likewise, her fourth frame (because it followed an "Oil Well") was a "bonus" frame ("Money Pit") and provided Sally with 5 additional points. Unfortunately, Sally drew a "Hangman" in the fifth frame, which penalized her for having an open frame by eliminating any and all accumulated non-regulation points. However, it is seen that Sally recovered nicely by scoring "bonus" points in the seventh and tenth frames ("Hammer Down") but was penalized in the eighth frame ("Gas Attack"). Sally completed two regulation games scoring a 172 and a 152, but totaled 45 points for her 20-frame non-regulation scored game. Both the regulation scored game and the non-regulation scored game may be compared to other players' totals. Typically, the non-regulation scoring will provide a cash award or other award which, frequently, may go to the player other than the player scoring highest in regulation play due to the greater luck factor built into menu scoring.

EXAMPLE 1 (Sally)

| 1 | 2 | 3 | 4 | 5 | 6 | 7 | 8 | 9 | 10 | TOTAL |
|---|---|---|---|---|---|---|---|---|---|---|
| JACK-POT | | OIL WELL | MONEY PIT | HANG-MAN 6 / 3 | 5 | HAM-MER DOWN 7 | GAS AT-TACK 7 / 2 | | HAM-MER DOWN 7 | 9 / 172 |
| 20 / 10 | 36 / 10 | 62 / 15 | 81 / 20 | 90 / 0 | 107 / 0 | 124 / 10 | 133 / 5 | 153 / 5 | 172 / 15 | 15 |
| 11 BOOT HILL 6 | 12 BOOT HILL 7 | 13 OOPS! 8 / 0 | 14 LUCKY SEVEN 7 | 15 HAM-MER DOWN 6 / 3 | 16 4 | 17 SPLITS-VILLE 8 / 1 | 18 | 19 GOLD MINE 9 | 20 9 / 0 | 152 |
| 17 / 15 | 35 / 15 | 43 / 10 | 59 / 30 | 68 / 30 | 86 / 30 | 95 / 35 | 115 / 35 | 143 / 45 | 152 / 45 | 45 |

EXAMPLE 2 (Sam)

| 1 | 2 | 3 | 4 | 5 | 6 | 7 | 8 | 9 | 10 | TOTAL |
|---|---|---|---|---|---|---|---|---|---|---|
| TREAS-URE CHEST 6 | 5 / 2 | HEADS TAILS 8 / 0 | | 7 NO TAP 9 | MAV-ERICK 7 | | JAIL-HOUSE 4 | | HEADS TAILS 7 | 5 / 162 |
| 15 / 30 | 22 / 37 | 30 / 29 | 50 / 56 | 67 / 86 | 87 / 116 | 107 / 126 | 127 / 126 | 147 / 153 | 162 / 175 | 175 |
| 11 3 | 12 HOLD-UP 6 / 3 | 13 | 14 5 NO TAP 6 / 2 | 15 MAV-ERICK 6 / 3 | 16 7 | 17 STRIKE OUT | 18 PADDY WAGON 7 / 0 | 19 TREAS-URE CHEST 6 | 20 8 / 0 | 130 |
| 16 / 191 | 25 / 184 | 43 / 216 | 51 / 244 | 60 / 262 | 80 / 272 | 97 / 272 | 104 / 272 | 122 / 305 | 130 / 313 | 313 |

Example 2 -illustrates a second format for applicant's unique method of playing a bowling game. Specifically, in Example 2, menu scoring is provided which is based on regulation scoring with "bonus" frames having the potential to add to that scoring and "penalty" frames having the potential for reducing that scoring. In Example 2, our hypothetical bowler is named Sam; and Sam has chosen 20 frames for his game. In addition to keeping score through a modified regulation scoring system, Sam will maintain, as Sally did in Example 1, regulation scoring and score two 10-frame games. Sam is a bowler of average skill, and rolls some spares, some strikes, and a few open frames. In Example 2, Sam has chosen to allow the computer to randomly select "bonus" frames as well as "penalty" frames and to randomly designate their locations in the 20-frame game. This has produced the print-out set forth in Example 2. However, in the alternative, Sam could be scoring on a computer monitor which does not show the entire format and adds an element of surprise.

Sam's first frame of the 20-frame game starts out well with a spare. The first frame is designated a "bonus" frame, specifically a "Treasure Chest", which allows the addition of 15 points to the regulation score if the bowler scores a spare (30 additional points for a strike). Thus, Sam has entered a 30 for his first frame. As a result of bowling an open frame in the second, scoring 7 pins in the two balls rolled. Unfortunately, Sam encountered a penalty frame in frame 3 and, bowling an even score, lost his pin count of 8 in his non-regulation score. The fifth frame was a "bonus" frame with a "7 No Tap". Having scored more than 7 pins on his first ball of the fifth frame, Sam is allowed to score it as a strike and, with a "Maverick" following in the sixth frame, is allowed to double his pinfall count for this frame. Thus, the modified regulation counts the fifth frame as a strike on the first ball, for a total of 10 pins to be added to the 10 for the fourth frame strike, plus 7 for the first ball in the sixth frame, to give a modified regulation score of 56 in the fourth frame. Now for modified scoring in the fifth and sixth frames, the "No Tap" is counted as a strike and the next two balls following the strike are a 7 (first ball in the sixth frame) and a 3 (the spare) on the second ball. However, the 7 and 3 are doubled since the sixth frame is a "Maverick" bonus frame, giving us a 10+14+6 pins for a total of 30, resulting in 86 as a modified score in the fifth frame. The pin count for modified regulation scoring in the sixth frame allows the bowler to double the pin count for the frame, which is 10, doubled as 20, and brings the modified regulation scoring to 116. Turning back to regulation scoring for the seventh and eighth frames, it is seen that a strike followed by a spare results in a 107 regulation score in the seventh frame and a 127 regulation score in the eighth frame. The seventh frame net no score for Sam, as no score is added unless a strike is rolled in the eighth, ninth or tenth frames. Thus, Sam's strike in the seventh was for naught in that he failed to score any points in the eighth frame. The 126 was carried to the eighth frame, but Sam is out of the "Jailhouse" by the ninth frame, when he bowls a strike. Therefore, the ninth frame can be scored on modified regulation by adding 10 plus the number of pins downed with the next two balls; however, the tenth frame is a "Heads" frame. This means that, if you get an odd number of pins on your first ball, the pin count is doubled. Here, on the first ball, Sam scored a 7, which is doubled to 14. Fourteen added to 3 on his second ball totals 17; counting the strike in the ninth frame, 27 is added to his eighth frame score for 153. Tenth frame scoring again doubles the 7 (to 14), plus 3 (for 17), to give a total of 175 as modified regulation. Sam carries the tenth frame modified scoring of 175 into the eleventh frame, where he rolls a spare followed by a 6 on his first ball in the twelfth frame, resulting in a modified score of 191. Of course, the eleventh frame will begin a new regulation game with a score of 16 in the first frame. The twelfth frame, however, is a "Hold-Up", which means that, if no strike is bowled for each pin left standing after the first ball, 4 points are taken from the modified scoring. Four pins were left standing, so 16 points were subtracted from the 191, but the 9 pins Sam got were added to the eleventh frame score to result in a 184 in the twelfth frame. The thirteenth frame is standard scoring, except that a strike was bowled and, in counting the next two balls, it will be noted that the first ball in the fourteenth frame (a "5 No Tap" frame) will be counted as a strike with the second ball counted being the first ball in the 15th frame, which is doubled for 12 points. Thus, 32 is added to the 184 in the twelfth frame to give a modified score of 216 in the thirteenth frame. To continue modified scoring, it is noted that the fourteenth frame is counted as a strike with the next two balls being a "Maverick" 6 (the first ball in the fifteenth frame) and a "Maverick" 3. The "Maverick" 6 is doubled to a 12 and the "Maverick"3 doubled to a 6; thus, 28 is added to the fourteenth frame for a 244. Further, the "Maverick" in the fifteenth frame doubles the score of the pin count (9) to add 18 to the fourteenth frame score to give a score of 262 in the fifteenth frame. The spare rolled in the sixteenth frame, which is a non-menu frame, would typically add 10 points to the score of the fifteenth frame. The seventeenth frame is a "Strike Out", which is in the nature of a penalty and does not allow for any modified scoring in that frame. Thus, the spare in the sixteenth frame has no pins added to it; and just carries the 272 modified score into the seventeenth frame. In the eighteenth frame, Sam is again penalized with a "Paddy Wagon", which means if the bowler does not mark in the frame, no score is received. Fortunately, Sam encounters a "Treasure Chest" in the nineteenth frame in which his spare allots him 15 additional points.

Thus, it is seen that the "Strike Out", "Paddy Wagon", "Jailhouse", "Hold-Up", and "Tails" penalty frames have taken their toll on Sam's modified regulation score. These were not offset by the "Treasure Chest", "Maverick" and "Heads" bonus frames. Nonetheless, Sam allowed the computer to randomly choose the frames and could have, under applicant's method of play, instructed the computer to choose and randomly place in the 20-frame game, for example, eight "bonus" frames and four "penalty" frames. Further, Sam could have designated the "bonus" and "penalty" frames he wanted and allowed the computer to randomly place them. Further, Sam could have chosen the "bonus" and/or "penalty" frames he desired and placed them himself.

TABLE 2

| (Handicap System) | |
|---|---|
| Average | Bonus/Penalty Ratio |
| <100 | 3:1 |
| 100–130 | 2.5:1 |
| 131–160 | 2:1 |
| 161–190 | 1.5:1 |
| 191–220 | 1:1 |
| >220 | .5:1 |

Table 2 indicates a handicapped system which may be played with either applicant's modified regulation or ancillary scoring system. The handicapped system increases the bonus-to-penalty ratio for the lower-average player and decreases it for the player of higher average skill. In fact, players over 220, under the handicapped system illustrated in Table 2, typically have about twice as many penalty frames as bonus frames. This system, fairly arbitrarily set forth, is a means of helping the below-average or lower-skilled player increase their supplemental score, be it modified regulation or ancillary scoring. It is noted that Sam, typically a 140 average bowler, would have done better under the handicapped system, as he would have had approximately a 2:1 ratio of bonus:penalty frames where the computer randomly selected a 7:5 ratio (about 1.4:1). A handicapped system can be built into the computer by means of equipment available and through the skill of those of ordinary skill in the art, which is similar to that set forth in Table 3.

TABLE 3

| | (Bonus/Penalty Indicia/Descriptions) | | |
|---|---|---|---|
| INDICIA | BONUS/ NO. | PENALTY | DESCRIPTION |
| 7 | 1 | No Tap | No Tap = a strike if you knock down the designated number of pins with first ball. There are 5 different types of No Tap frames, i.e.: 9 No Tap, 8 No Tap, 7 No Tap, 6 No Tap, and 5 No Tap. |
| | 2 | Jack Pot | Strike = 10 bonus skins. |
| | 3 | Money Pit | No strike = Pay $1.00 into the skins pot. |
| | 4 | Take Two | Don't like your first ball? Do it over! |
| | 5 | Gas Attack | Must mark or loose 5 bonus skins. |
| | 6 | Gold Mine | Receive 1 bonus skin for each pinfall. Strike = 15 bonus skins. |
| | 7a | Heads | On your first ball, if you get an odd number count on your pinfall, your pin count is doubled. |
| | 7b | Tails | On your first ball, if you get an even number count on your pinfall, the points are subtracted from your score. |
| | 8 | Penalty Box | If one or more players get a strike, then any players who do not must pay 25¢ per frame into the skins pot for their next consecutive frames until they get one. |
| | 9 | Mother Lode | This is a progressive pot that builds each week until someone gets six strikes in six Gold Mine frames. In order to have a Mother Lode pot, you must have no more than six Gold mine frames in your game. |
| | 10 | Oil Well | Strike = 5 bonus skins + 5 more skins for each consecutive strike in the next frames until you miss. |
| | 11 | Hangman | No strike = lose all bonus skins up to this frame. |
| | 12 | Hold-Up | No strike = for each pin left standing after the first ball, 4 points are taken from your score. |
| | 13 | Treasure Chest | Strike = +30 pins; spare = +15 pins. |
| | 14 | Jailhouse | No strike = no score in this frame or the next two unless you roll a strike; counts as a strike in modified regulation play. |
| | 15 | Cut Throat | Strike = you can put any bowler of your choice (who has a higher score on the opposite team) in jail. You can only be put in jail by another player once per game. If you are put in jail by another player (and you roll 3 consecutive strikes in your next frames), you can put that person in jail, so long as they haven't already been in jail during the game. |
| | 16 | Maverick | All pin count is doubled. |
| | 17 | Lucky Seven | Roll a seven count with either ball and receive 20 bonus skins. |
| | 18 | Boot Hill | You must mark in this frame or lose 10 bonus skins. |
| | 19 | Hammer Down | Mark in this frame and receive 10 bonus skins. |
| | 20 | Money Bags | Must mark or pay $1.00 into the skins pot. |
| n/a | 21 | Splitsville | 7–10 split = 5 bonus skins. |
| n/a | 22 | Oops! | Gutterball in this frame = loss of 5 bonus skins. |
| n/a | 23 | Transfer | Add pinfall on first ball as bonus skins. |
| n/a | 24 | Transfer | Subtract pinfall on first ball as loss of bonus skins. |
| | 25 | skins | No one goes below "0". |
| | 26 | Strike Out | Strike = No score. |
| | 27 | Paddy Wagon | No strike or spare = No score. |

Table 3 indicates the nature of the 20 menu frames and how they were scored. Also, Table 3 indicates an indicia next to each one, which may be used on the bowling print-out or computer monitor to help identify a menu scored frame.

Applicant's method also includes the step of generating an array of game formats so that, for example, the bowling center may offer players a multiplicity of preformatted games to choose from. These games may be cataloged or separated according to levels of difficulty. For example, a bowling center could offer, either through a computer or through hard copies, such a cataloged array. Each of such games would typically have a distinctive title and typically be designated by degree of difficulty. Such an array, or even pre-formatted individual games, may be offered on computer software.

Terms such as "left," "right," "up," "down," "bottom," "top," "front," "back," "in," "out," and 1 ike are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A method of playing a multiple-frame bowling game on a bowling alley, said method comprising the steps of:

a) selecting a number of frames to comprise a complete game, said number of frames between 5 and 1000 frames;

b) providing a menu, the menu including a multiplicity of bonus frames and a multiplicity of penalty frames for non-regulation scoring;

c) designating at least one of the game frames as a menu frame;

d) commencing regulation play by a player delivering a bowling ball to preset pins;

e) altering regulation bowling play when a player encounters said at least one designated menu frame, according to the play modification requirements of said at least one designated menu frame;

f) recording the players' non-regulation score according to instructions set forth in the menu of said providing step by adding to the score for bonus frames or subtracting from the score for penalty frames;

g) totaling the players' non-regulation score following completion of the last frame of the game; and h) comparing the non-regulation scores of each player to determine the winner.

2. The method of claim 1 further comprising the steps of:

recording a player's regulation score; and totaling, according to regulation play, a player's regulation score following the completion of each ten consecutive frames played, beginning with the first frame.

3. The method of claim 2, wherein the designating step includes the random placement of at least one penalty frame and at least one bonus frame between the first and the last frame, inclusive, of the complete game.

4. The method of claim 1, wherein the designating step includes the random placement of at least one penalty frame and at least one bonus frame between the first and the last frame, inclusive, of the complete game.

5. The method of claim 4, wherein the providing step includes the step of providing a computer and wherein the random placement is computer generated.

6. The method of claim 5 further comprising the steps of:

recording a player's regulation score; and totaling, according to regulation play, a player's regulation score following the completion of each ten consecutive frames played, beginning with the first frame.

7. The method of claim 5 further including, following the designating step, the step of providing a print-out of the complete game, the print-out having indicia for referencing the designated menu frames.

* * * * *